US006430889B1

(12) United States Patent
Nixon, Sr.

(10) Patent No.: US 6,430,889 B1
(45) Date of Patent: Aug. 13, 2002

(54) FRAMING STRUCTURE FOR OPENINGS, PARTICULARLY DOORWAY SIDE LIGHTS

(75) Inventor: Dennis Eugene Nixon, Sr., Duncansville, PA (US)

(73) Assignee: Signature Door Co. Inc., Altoona, PA (US)

( * ) Notice: Subject to any disclaimer, the term of this patent is extended or adjusted under 35 U.S.C. 154(b) by 0 days.

(21) Appl. No.: 09/844,106

(22) Filed: Apr. 27, 2001

(51) Int. Cl.[7] ..... E06B 1/04

(52) U.S. Cl. ..... 52/656.4; 52/204.1; 52/309.9; 52/656.5; 52/742.13; 52/742.15

(58) Field of Search ..... 52/204.1, 213, 52/309.9, 309.14, 656.7, 656.4, 656.5, 742.13, 742.15; 49/504

(56) References Cited

U.S. PATENT DOCUMENTS

| | | | | |
|---|---|---|---|---|
| 1,483,851 A | | 2/1924 | Perry | |
| 3,811,238 A | * | 5/1974 | Brinker | 52/211 |
| 4,409,768 A | * | 10/1983 | Boden | 52/309.4 |
| 4,720,951 A | * | 1/1988 | Thorn et al. | 52/208 |
| 4,787,131 A | * | 11/1988 | Pacca | 52/742.13 X |
| 4,870,797 A | * | 10/1989 | Hagemeyer | 52/455 |
| 4,882,877 A | * | 11/1989 | Guetle, Jr. et al. | 49/506 |
| 5,022,206 A | | 6/1991 | Schield et al. | |
| 5,720,142 A | * | 2/1998 | Morrison | 52/309.9 |
| 6,148,582 A | * | 11/2000 | Ellingson | 52/656.4 |
| 6,345,477 B1 | * | 2/2002 | Kepler et al. | 52/204.1 |

FOREIGN PATENT DOCUMENTS

| | | | |
|---|---|---|---|
| JP | 405302466 | * 11/1993 | 52/204.1 |
| JP | 406026271 | * 2/1994 | 52/204.1 |

* cited by examiner

*Primary Examiner*—Carl D. Friedman
*Assistant Examiner*—Brian E. Glessner
(74) *Attorney, Agent, or Firm*—Duane Morris LLP

(57) ABSTRACT

A finish mounted framed building element such as a window or doorway sidelight or the like is mounted in a space provided in rough framing structures in a wall, by inserting facing sheets, preferably of sheet metal, into the framing jambs up to a variable depth in slots provided at the perimeters of the door or window frame opening. The space between the sheets can be substantially confined as a foaming composition is injected and permitted to expand and cure in place. The foam locks the sheets to the framing jambs of the window or doorway sidelight, etc. This provides a wall panel with a correctly sized and correctly positioned internal opening, for example to receive a window frame or doorway sidelight or other insert structure. The invention also supports or reinforces the window or doorway generally, for example to support the hinged side of a door jamb adjacent to a door sidelight.

19 Claims, 6 Drawing Sheets

FRAMING STRUCTURE FOR OPENINGS, PARTICULARLY DOORWAY SIDE LIGHTS

BACKGROUND OF THE INVENTION

1. Field of the Invention

The invention relates to structures by which panel elements are mounted in openings in static structures, and is particularly applicable to a doorway side light that contributes support to a door jamb.

2. Prior Art

Doorways such as exterior entrance doors for residences typically have one or two door panels that are carried on frame members fixed in an opening. Each door panel swings on hinges attached to a vertical frame member or jamb. There is a hinge-side jamb and a latch-side jamb. The hinges define vertical hinge axes, and the center of gravity of the pivoting door panel, which corresponds more or less with the center of the door panel, is cantilevered or held at a horizontal distance from the hinge axis of the door. Thus the weight of the door panel is applied to the jamb that carries the door panel, in a direction that urges the jamb to tilt toward the door panel. The specific direction changes, because the door panel is hinged and movable between open and closed positions in which the tilting or sagging force is perpendicular to the plane of the doorway or perpendicular, respectively.

A door and its frame members, including laterally spaced vertically elongated door jambs and a top frame or header, can be fitted and assembled in place, but it is convenient and often more accurate to use a door that is pre-assembled for installation as a unit (usually termed "pre-hung"). The installation involves carefully placing and affixing the finish frame that carries the door panel, in a rough framed opening that is slightly larger than required by the finish frame. The extra space is used not only for clearance when maneuvering, but also to permit adjustments to be made as necessary, so that the finished door frame will be nominally positioned.

It is possible deliberately to place the hinge axis of a door so as to tilt slightly. An inward tilt causes the door to swing closed when unsupported, and vice versa. However it will be assumed for purposes of this description that the building wall is nominally vertical and the door hinge axis is intended to be vertical as well (so there is no tendency of the door to swing open or closed). In that case, it is still very common that the rough framing members defining the opening may not be positioned exactly correctly. The door jambs nominally need to be coplanar with the wall of the building and vertical. The jambs must not only be vertical and parallel, but also should be precisely at the same elevation so that the header is horizontal and parallel to the sill.

Windows comprising sashes in frames, and pre-hung doors comprising a panel hingeably attached to a jamb of a frame, normally are installed in rough openings by means of wedges. The frame is placed in the rough opening, which as noted above is slightly larger than necessary. Wedges or shims that are inclined in opposite directions are slid over one another at spaced points around the frame, such as at two points along each elongated frame member such as a jamb or header, to adjust the spacing between the frame member and the edges of the rough opening. By incrementally increasing and decreasing the spacing at the respective points, the frame members are adjusted in position. This technique can be used to ensure that the frame members are mutually parallel and perpendicular, and to center the frame in the opening. After the frame is accurately placed, nails or screws are driven through the wedges to fix the position of the frame.

The rough framing members provide the ultimate load bearing function. The finish framing members, such as the jambs, carry the door panel by transferring the load to the rough framing members through the wedges. The wedges provide the rigid connection with the load bearing rough framing members. Although the wedges simply fix the width of gaps between the finish frame members (e.g., the jambs) and the rough framing studs at spaced points, they wedges provide a sufficient structural connection to bear the weight of the door panel. The gap between the jambs or other finish frame elements and the remainder of the wall can be stuffed with insulation and covered with moldings that conceal the gap between the jambs and the rough framed wall.

The foregoing technique basically involves building a rectilinear panel (such as a window or doorframe) and mounting it in a rough framed opening. The panel is not so much a structural element as it is a device that occupies a position, being mounted in a frame that is expected to provide any necessary structural support for the building by distributing and bearing loads apart from applying the loads to the panel.

For doors, especially for heavy solid wood doors and the like, it may be advisable to pay particular attention to supporting the jambs. The jamb on the hinge side will be especially subject to sagging forces from the door panel. A hinge-side jamb can be affixed to the rough framing members for support. The framing supporting the door jambs can be accomplished with doubled or tripled studs or similar reinforcing structural members. In this connection, a conventional rough framed opening may have doubled or tripled combinations of full length studs known as king studs, and shorter studs known as trim studs and cripple studs, which are attached along the sides of the king studs so as to extend under and over the horizontal header. In this way, the door jambs, particularly on the hinge side, can be intimately attached to the rough framing to solidly support the weight of the door.

In certain doorway and entranceway arrangements, problems associated with supporting the door jambs (or supporting a window or another sort of panel device) are compounded by the fact that areas immediately adjacent to the jambs of the frame on one or both sides, are occupied by decorative panels. For example, in an entranceway, so-called sidelights may be provided at a position laterally adjacent to the door jamb on one or both sides. This may comprise a decorative structure with panels and/or window panes (transparent or translucent) that occupy the full height of the door on either side. Inasmuch as this space is occupied by decorative panels, the nearest heavy load bearing rough framing members are on the lateral outsides of the entranceway. They are not simply on the lateral sides of the door jamb, which area is occupied by the door sidelights.

A typical entryway as discussed in most of the examples in this description has a traditional single door panel, but two panels are likewise apt. Two panels hinged at lateral outside jambs are a traditional configuration known as French doors. According to one possible arrangement, there are fixed side panel structures disposed symmetrically on both lateral sides of an entrance way, each being narrower than the width of the door panel. Such a side panel could be provided on only one side and if on both sides may be non-symmetrical or of some other width. Additionally, there are various specific structures of decorative side panels. They may have full height single decorative panels or several smaller panels. They may be configured with some transparent or translucent panels and some opaque panels. All the panels might be opaque, etc.

All these arrangements have at least one decorative panel mounted on at least one side of a jamb, and are apt for the structure according to the invention. The usual nature of the structural connections provided in a structure comprising panels as described, is that the panels are self contained unitary or modular structures that are mounted on the larger arrangement. The panels are placed adjacent to one another or hung in an array using framing members such as mutually perpendicular rails and stiles. This places the panels where appropriate for decorative purposes, but the panels do not contribute substantially to the structural strength of the construction. Instead, the panels are decorative place holders only.

Whether such panels are doors or sidelights or transoms, they typically comprise box-like panels that can be solid or sheathed. In a sheathed arrangement for a door panel or a sidelight panel, the sheathing, such as sheet metal or a plastic molding, must be turned around right angles at the corners and typically joined at some form of seam whereby the sheathing material defines a hollow box that can remain hollow or can be filled with some form of structural reinforcement or thermal insulation.

U.S. Pat. No. 5,022,206—Shield et al., which is hereby incorporated in its entirety, discloses an exemplary conventional entranceway arrangement, which also employs foam core construction. The movable door panel, which obviously is discrete because it is independently movable, and also a number of discrete panels that are disposed along the lateral sides of the door, are carried on frame elements. The frame elements comprise a header and a sill at the top and bottom of the entranceway, two laterally outermost peripheral frame members that extend between the ends of the sill and header, and two intermediate frame members spaced inwardly from the peripheral frame members, which function as the hinge-side and latch-side door jambs. The decorative sidelights are disposed between the door jambs and the lateral outside frame members. The sidelights are substantially the same as windows, namely discrete unitary panels in which one or more glass panes are mounted in a frame. The sidelight frames are placed in the space between the door jambs and the peripheral frame members. They are decorative panels inserted into the structure rather than structures that are intimately attached to one or more of the peripheral frames, the jambs and the header and sill. At times, blocks were inserted into such structures to provide points of attachment; however their function was still more decorative than structural.

In Shield et al., portions of a sidelight structure have a sheet metal skin, and a foamed core is disposed between the spaced sheets forming the skin. A core as described is light in weight, and provides good thermal insulation. In addition, the foam can conform to any particular shape or dimension. Shield uses the foam core in a door panel and in portions of a side light that form a frame around glass panels. The foam core is contained in part by plug members that are provided at certain ends of the respective panels between the skin sheets, and define boundaries or perimeters for the volume occupied by the foam core. Thus, for example, the plug members are disposed between the sheets around the outer edge of the door panel. The plug members are useful not only for bounding the volume, but also present a solid edge of a material other than foam, which can be mortised for hinges or a lockset, and can receive fasteners, etc. The resulting panel construction, for example for the door, is very much the same as a door built in some way other than using a foam core, for example having rails and stiles holding panels. The door is mounted on hinges in a conventional manner.

The Shield sidelight panels, comprise glass panes in a peripheral frame having foam bounded by skin and plug members. Thus the sidelight panels also have to be treated in the same way as self contained panels having other internal structures, which are monolithic bodies that must be affixed in an entranceway.

Windows are frequently treated as monolithic decorative inserts into a framed space, whose structural contribution to the whole is limited. For example, windows are mounted with spaced wedges that are such that the windows only actually engage the framed elements at spaced points. Entranceways are also treated in a manner very similar to windows, in that the entranceway is merely placed in a framed entranceway opening. The entranceway is structured to withstand the weight of the door panel and also various opening/closing loads and related loads that may arise, for example, from slamming of the door, wind action driving it open, children swinging on the door, etc. The door panel may contribute to the structural support of the overall structure when closed, but for the most part the door panel is not helpful for structural support. Instead the panel merely occupies a space and needs support instead of contributing support. Similarly, door sidelight panels, which are nothing more than windows that do not open, are panels that occupy the space between the jambs and the peripheral framing. The sidelights panels are not integrally attached to the other framing elements and serve to decoratively occupy space rather than to contribute structural strength.

Thus, in the example of a doorway, the structurally pertinent elements are the rough framing elements that bound the doorway and open a space. The rough framing elements are arranged to avoid reliance on the door jambs and entranceway frame for structural support. Instead, the rough framing is structured to support the weight of the structure around and over the entranceway. A heavy header member of plural studs or two-by-sixes is disposed over the vertical framing studs at the lateral sides of the opening. The vertical stud are doubled or tripled, including full length "king" studs, "cripple" studs abutting under the header from above and "trim" studs extending along the king studs under the header. The entranceway, including the door jambs, lateral frame members, header frame and sill, occupy the space reserved in the framing.

Doorways and doorway sidelights conventionally are much the same as windows. A rough opening is provided in the framing studs. The sidelight is provided as a pre-assembled finish framed element that is mounted in the rough opening. The sidelight frame is a discrete module that is placed coplanar with that wall at a predetermined depth. Wedges are placed along the sides, top and bottom and the thickness of the wedges is varied until the sidelight frame is rigidly positioned. Fasteners such as screws or nails are extended through the finish frame elements and the wedges into the rough frame elements. For external doorways, insulation is stuffed into the wedge-defined gaps. Moldings are installed on the inside and outside of the wall, to bridge over and conceal the wedge gap.

A critical aspect of such doorway sidelights is that they occupy the space laterally adjacent to one or both door jambs. The sidelights, which often are of minimal thickness and comprise glass panes, effectively displace the structurally supportive studs and framing members that might be located at and attached to the door jamb, with decorative non-supportive structures such as window panes. The lack of this structural support can be a problem, especially for the hinge-side door jamb.

Door panels and window panels are often structurally similar. A door panel having a door light (i.e., a window pane mounted in the movable door panel), has a peripheral frame part holding the window pane. Similarly, a window with a stationary pane or a movable window sash (i.e., a pane fixed in a movable frame), has a pane similarly carried in a peripheral frame. It is known to make door panels and windows with foam cores. Among other things, the foam core provides a form of thermal insulation between the inner and outer sides of the door or window. A sheet metal skin can face the panels. For the edges, the skin is typically folded around the ends, but it would also be possible as in Shield et al., to use wood or similar plug members to form the edges between the sheet metal skin parts. Such doors and windows, like doorway sidelights and decorative doorway side panels, are substantially nonsupportive structures that displace supportive framing structures that could otherwise occupy the same space.

It would be advantageous, and it is an aspect of the present invention, that structures such as door sidelights and fixed pane windows are optimized to make a substantial structural contribution to the structure, such as an adjacent doorjamb, instead of being used simply as a nonstructural decorative add-on to other members that function as load bearing elements. To accomplish this, these otherwise decorative structures are structured appropriately and are intimately and integrally attached to one another and to other structural parts, so as to form a series of securely attached rigid members, as opposed to a frame in which space has been reserved to hang a nonstructural panel.

According to the present invention, this is achieved in part by intimately attaching the decorative part to the framing parts using a mechanical engagement held by a cured foam body. It is known to provide foamed cores in building panels, doors and the like, for example to improve their thermal insulation properties as compared to solid wood or other panel material. For doors and also the decorative portions of entranceways that are disposed laterally around some doors, this is typically accomplished by providing a foam body such as a foamed polystyrene (Styrofoam) panel, and adhesively attaching a plastic or metal surface material. It is also known to provide a plastic or metal body that defines a box-shaped hollow internal volume, and to fill the hollow with a foam that is cured in the body. A foam core structure formed in one of these ways is advantageously light in weight and has good thermal insulation properties due to the air spaces trapped in the foam. However, foam core structures typically are not intended to bear any substantial structural loads. They are often readily distinguished from solid structures, which are considered of higher quality. Light foam core structures are sometimes considered cheap, and less desirable than more robust and durable solid structures used to bear loads and to carry weight.

SUMMARY OF THE INVENTION

It is an object of the invention to improve the structural integrity of buildings comprising finish framed elements that occupy spaces in structures comprising load bearing frame elements.

It is also an object of the invention to reduce or eliminate the need for substantial carpentry skill and attention to achieve accurate mounting of a finish framed element in a rough or load-bearing framed opening of a building structure.

It is another object of the invention to improve the appearance and structural robustness of window and door framing elements, including but not limited to doorway sidelights, while also reducing the difficulty of their installation.

These and other objects are accomplished by a finish mounted building element such as a window or doorway sidelight or the like that is mounted according to the invention in a space or opening provided in rough framing structures in a wall. In particular, facing sheets, preferably of sheet metal, are spaced to define a thickness, and are inserted and supported in slots provided in members to be disposed at the perimeters of the opening. The sheets are insertable into the slots by a variable or adjustable depth, which permits an inner opening defined by the sheet metal to be adjusted, e.g. for plumb or centering, or to ensure precise registry of openings in spaced sheets for opposite sides of the element, etc. The sheets and slotted members are supported in their final positions, e.g., being disposed in a supporting jig. The space between the sheets is injected with an expanding structural foam, which expands, preferably fills any remaining space and bonds to the sheets and slotted members, and is permitted to cure in place. This provides a wall panel with a correctly sized and correctly positioned internal opening, for example to receive a window frame or doorway sidelight or other insert structure. The slots for the facing sheets can be co-linear with the sheets or the slots can diverge such that injecting the foam between the facing sheets urges the facing sheets apart and locks the facing sheets in the slots by their edges diverging from a crease in the sheets at the openings for the slots. In any event, the foam urges the sheets to the outsides of the slots and fills any remaining space.

The sidelight construction is sufficiently strong as to the inherent materials, and moreover by the durable way in which they are attached together, that a conventionally dimensioned sidelight constructed as described can easily structurally support virtually any type of adjacent door panel (i.e., all but the very heaviest types), supplanting the need for reinforcing studs or the like at the positions they displace. The sidelights of the invention are particularly useful to improve the structural support provided to a hinged or latch side door jamb, and preclude the need for thick framing or reinforcing members in the same areas of the structure.

BRIEF DESCRIPTION OF THE DRAWINGS

There are shown in the drawings certain embodiments of the invention as presently preferred. It should be understood that the invention is not limited to the precise arrangements and instrumentalities shown in the drawings, wherein the same reference numbers refer to the same parts in the respective views, and wherein.

DETAILED DESCRIPTION OF THE PREFERRED EMBODIMENTS

Figure 1:
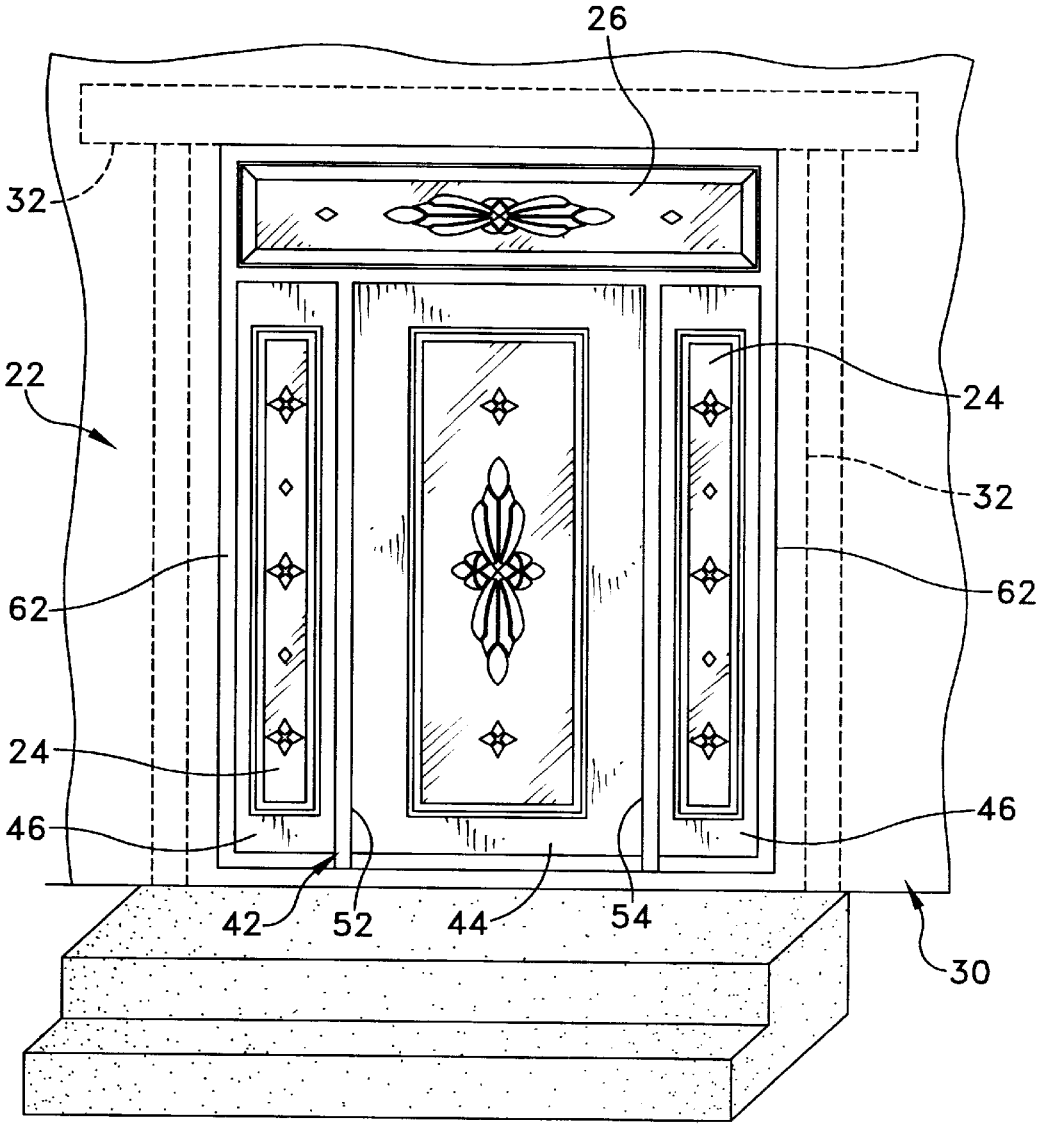
FIG. 1 is partial perspective view showing a building with an entranceway according to the invention, as installed and including a door toplight or transom.

An exemplary installation of the invention, namely an entranceway 22 with two sidelights 24 and a transom 26, is illustrated in FIG. 1. The building 30 has rough framing elements 32 that define a framed opening for the entranceway 22, which can comprise a pre-hung door unit 42 that is integrally constructed and installed as a unit in the framed opening. The unit can use any conventional door material, such as wood, metal or a polymer for the door panel 44. In a preferred embodiment, the door panel 44 and the panels 46 containing the sidelights are similarly constructed of galvanized steel sheets containing a foam core and defining an opening in which framed decorative panels are received, e.g., with transparent or translucent glass.

As a pre-hung unit, the door panel 44 fits precisely between spaced elongated jambs or vertical frame members 52, 54 on the hinged side and on the latched side, respectively. The jambs 52, 54 extend between a horizontal header 56 and sill 58 frame members. The header 56 and the sill 58 extend lateral past the opening provided for the door panel 44 and between them a contiguous space is defined for the door panel 44 and the lateral side lights.

The side lights as described herein are for the most part considered decorative items. However, they are also functional in that they allow light into the building. As a security feature they also permit an occupant to see who is calling before opening the door. If constructed according to the invention, the side lights also have a structural function and tend to make the door panel more solid and secure as it operates within jambs 52, 54.

The side lights are disposed immediately adjacent to the hinge and latch side jambs 52, 54, and reside between the respective jambs 52, 54, and two additional outermost frame members 62. The lateral outer frame members 62 are those that are attached to the "rough" framing members 32, namely the load bearing members of the structure, for example in a conventional manner using nails driven through wedges that are used to align the overall pre-hung door entranceway unit 22 in the rough framed opening.

Figure 2:
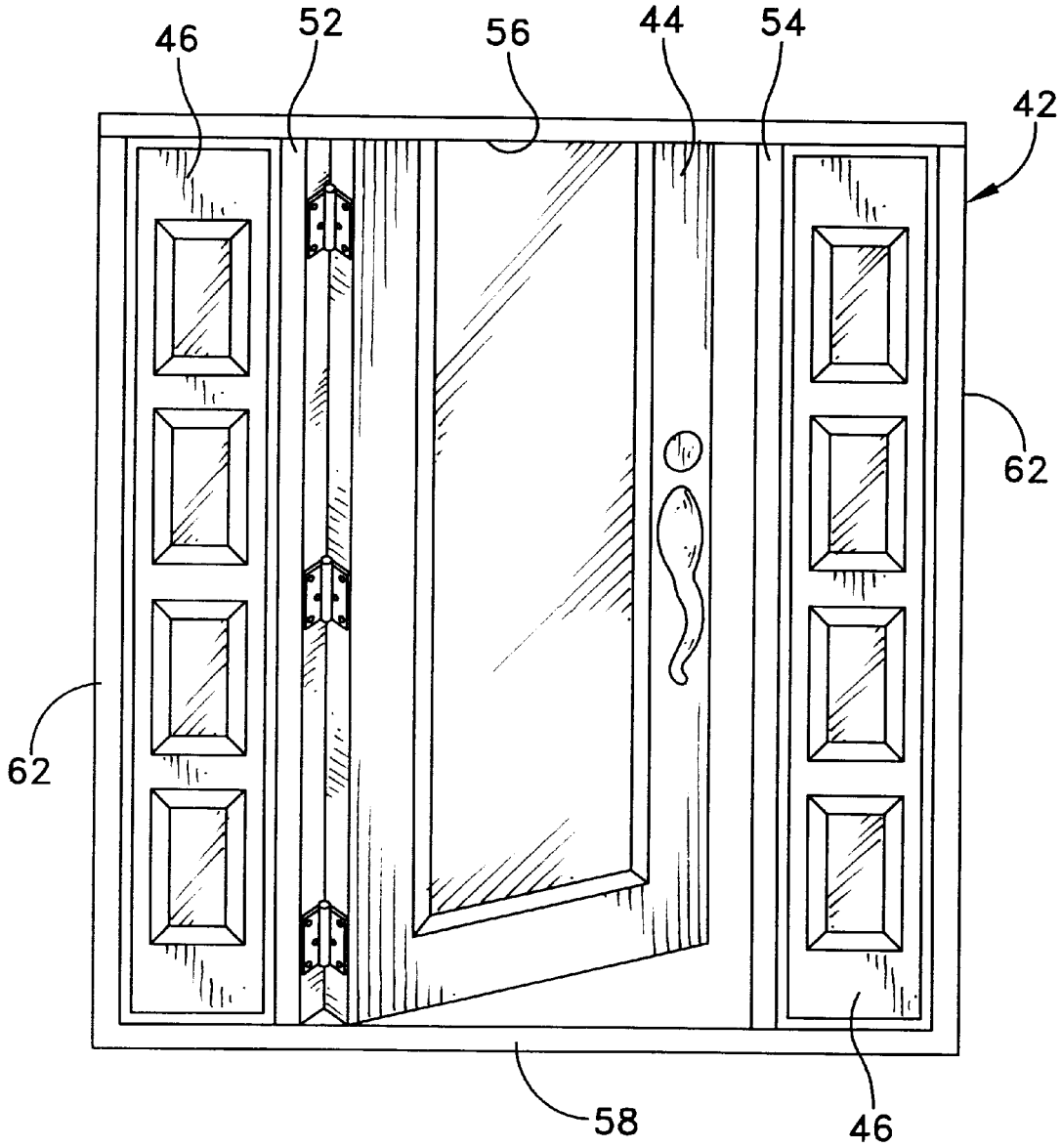
FIG. 2 is an elevation view showing an entranceway according to the invention in the form of a pre-hung door and attached sidelights.

The entranceway 22 can be varied as to the particular shapes, sizes and relative placement of its structures. For example, the transom 26 can be omitted as shown in FIG. 2. Instead of glass sidelight panes as in FIG. 1, the invention can be embodied with opaque panels such as molded or wood raised panels as suggested by the small individual panels in each side light in FIG. 2. The door panel 44 similarly can have a glass part (i.e., a door light), or can be a monolithic solid or can have rails and stiles carrying panels. etc.

Figure 3:
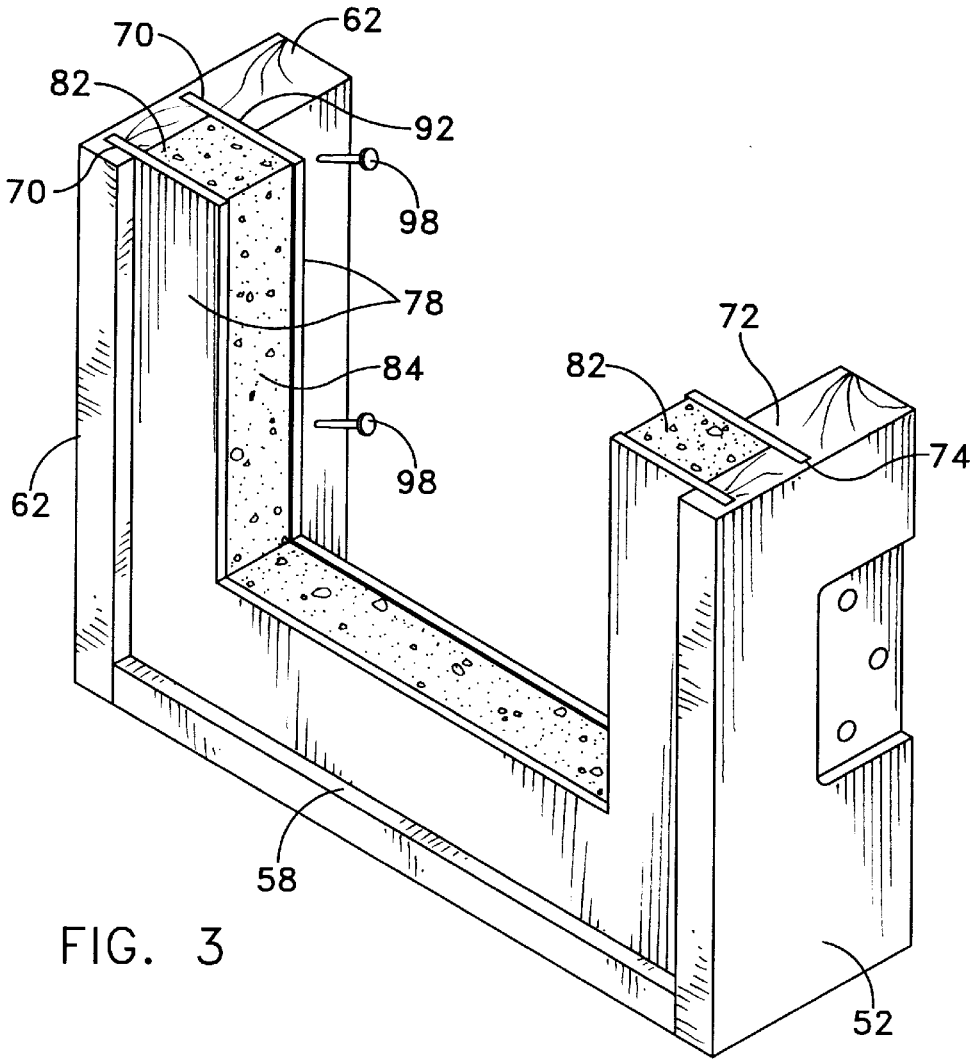
FIG. 3 is a partial sectional perspective view illustrating a first embodiment.
Figure 4:
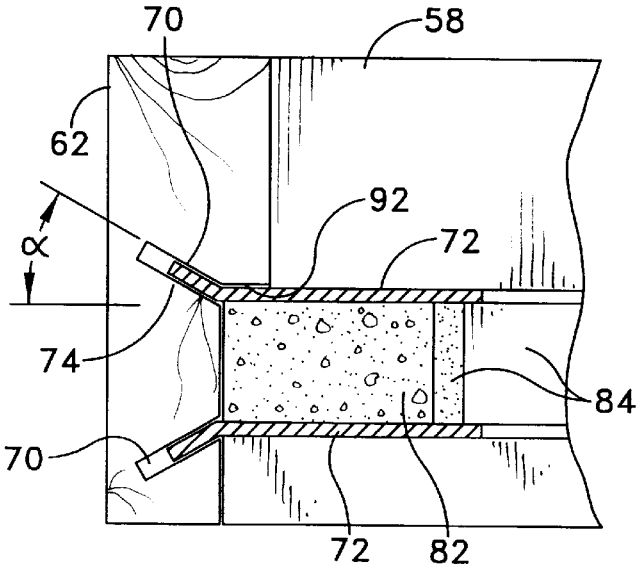
FIG. 4 is a partial sectional view corresponding to FIG. 3, illustrating an alternative embodiment in which the slots or kerfs for the sheet metal facing sheets are inclined and the foamed volume is bounded by wood strips.

Referring to FIG. 3 and the alternative embodiment in FIG. 4, the entranceway 22 is structured such that at least one said of the respective framing structures 62, 52, 54, 56 and/or 58 has a slot 70 defining a depth extending at least partly laterally away from the entranceway opening into such framing structure (62 in FIG. 4). The finish structure mounted in the framed opening, in particular the framed part that carries the doorway sidelights in the embodiment shown, engages with the peripheral framing element 62 at the slot 70. As shown in FIG. 3, one or both of the slots 70 can be coplanar or colinear with its respective facing sheet. As shown in FIG. 4, one of both of the slots 70 can be oriented at a divergence angle ∀, which tends to stiffen the facing sheets and also provide for a more extensive mechanical connection between the sheets 72 and framing element 62.

As shown in both FIGS. 3 and 4, the finish structure (the side light frame) comprises a sheet metal sheathed foam core structure having a facing sheet 72 on each opposite side, that protrudes into its corresponding slot 70. The facing sheet 72 can extend into the slot 70 by an adjustable distance to accommodate some dimensional variation less than or equal to the full depth of the slot 70, particularly using the arrangement of FIG. 3, wherein the slot is parallel to the doorway plane.

In the preferred arrangement, which is factory assembled as a pre-hung door configuration, the slots 70 are 1/16" wide and 1/4" deep for an arrangement in which the sidelight panels are about one inch thick and the frame extends about 1 11/16" from the adjacent jamb to the glass. The facing sheets are preferably 18 gauge steel, and thus fit into the slots easily with some lateral clearance. However forming the foamed core between the sheets typically forces the sheets to the lateral outer edge of slots 70. The foam also tends to flow and expand into the slots 70 with the sheets, which fixes the sheets at the outside of the slots and also provides an adhesive attachment of the sheets and the foam and the framing elements.

Preferably, as shown in FIG. 3, the framing members 62 and 52 or 54, on both opposite sides of an opening for a doorway sidelight, have slots 70 and receive one of the opposite ends of the facing sheets 72 on both opposite sides of the sidelight. The slots can be parallel to the plane of the sheets (FIG. 3) or the ends 74 can be bent into an inclined tab shape (FIG. 4), complementary with a slot 70 that is inclined relative to the plane of the respective sheet. Of course it is also possible to provide one straight slot and one inclined one, or to incline the slots at different angles, etc.

The sidelight or other similar finish structure comprises a foam core 82, namely a continuous body of cured closed cell foam that has been expanded in and fills the space between the facing sheets 72, i.e., a foamed core that is cured in situ. The foam core 82 extends up to and abuts against the framing structure 62, 52, 54, 56, 58 containing the slot 70. The foam core 82 can comprise a moderately low density urethane foam that is mixed with components that produce a gas evolving reaction and is injected in liquid form and expands to fill the available space. The urethane foam is sticky and it bonds adhesively to the inner facing surfaces and expands to fill the available space, thus providing a "solid" or continuous core of foamed urethane with good structural strength as well as good thermal insulation properties.

Referring to FIG. 3, the finish structure of each door sidelight panel comprises two said facing sheets 72 spaced from one another and oriented substantially parallel to a plane of the wall in which the entranceway 22 is installed. The sheets 72 extend over a part of a lateral width of the opening and define an edge or framing that is bound structurally to the remainder of the entranceway structure and defines an inner opening that receives a framed pane.

The foamed core 82 is disposed between the sheets 72 and preferably bonds to the sheets. The foam expands between the time that is poured or injected, so long as the blowing agent evolves gas. Sufficient foam is injected that by the time that curing sets the foam 82, it has filled the available space between the facing sheets 72. It is not necessary to be precisely accurate if there is space for the foam to expand out of the space (which excess is later trimmed, or if the available volume is bounded and the parts bounding the volume are supported as the foam expands. Preferably, the slotted members and the facing sheets are held precisely in position by a positioning jig (not shown), which fixes their position in known manner during the foam filling and curing steps that serve to attach these elements durably together into an integral body.

As described above, part of the structure that holds the facing sheets in position relative to the jambs or frame elements is the engagement of the tab parts 74 of facing sheets 72 in the kerfs or slots 70 provided in the frame elements. The volume containing the foam core 82 is bounded by the sheet metal skin or sheathing panels 72, by the framing 62 or jamb 52, 54 on the perimeter of the side light panel. A strip 84 of wood, Styrofoam or the like, may be placed permanently between facing sheets 72 along the perimeter of the opening that will receive the pane or panel of the side light, to confine the foam around the sidelight opening as shown in FIG. 4. In that case no trimming of the foam is required except perhaps for minimal sprue escaping the volume between the facing sheets. Alternatively, a removable barrier (not shown) can be associated with the jig that holds the parts in position during the foam insertion process, such that the space between the sheets is wholly occupied by foam as in FIG. 3.

Figure 5:
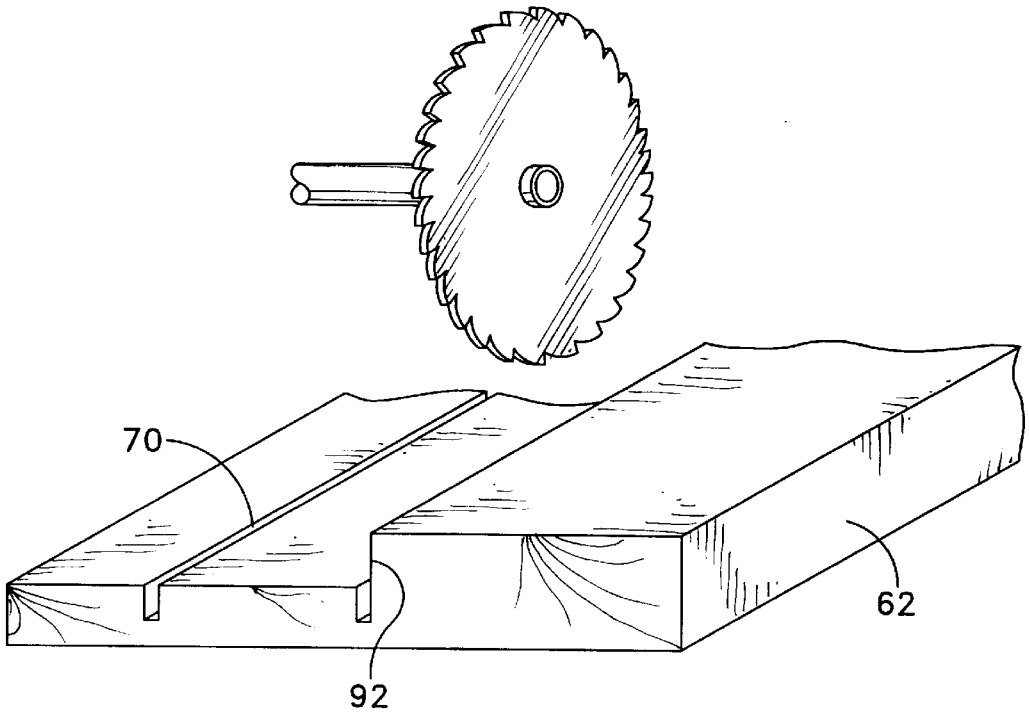
FIG. 5 is a cutaway perspective view illustrating certain steps in accordance with the invention, associated with forming finish framing elements for the entranceway of the invention.
Figure 7:
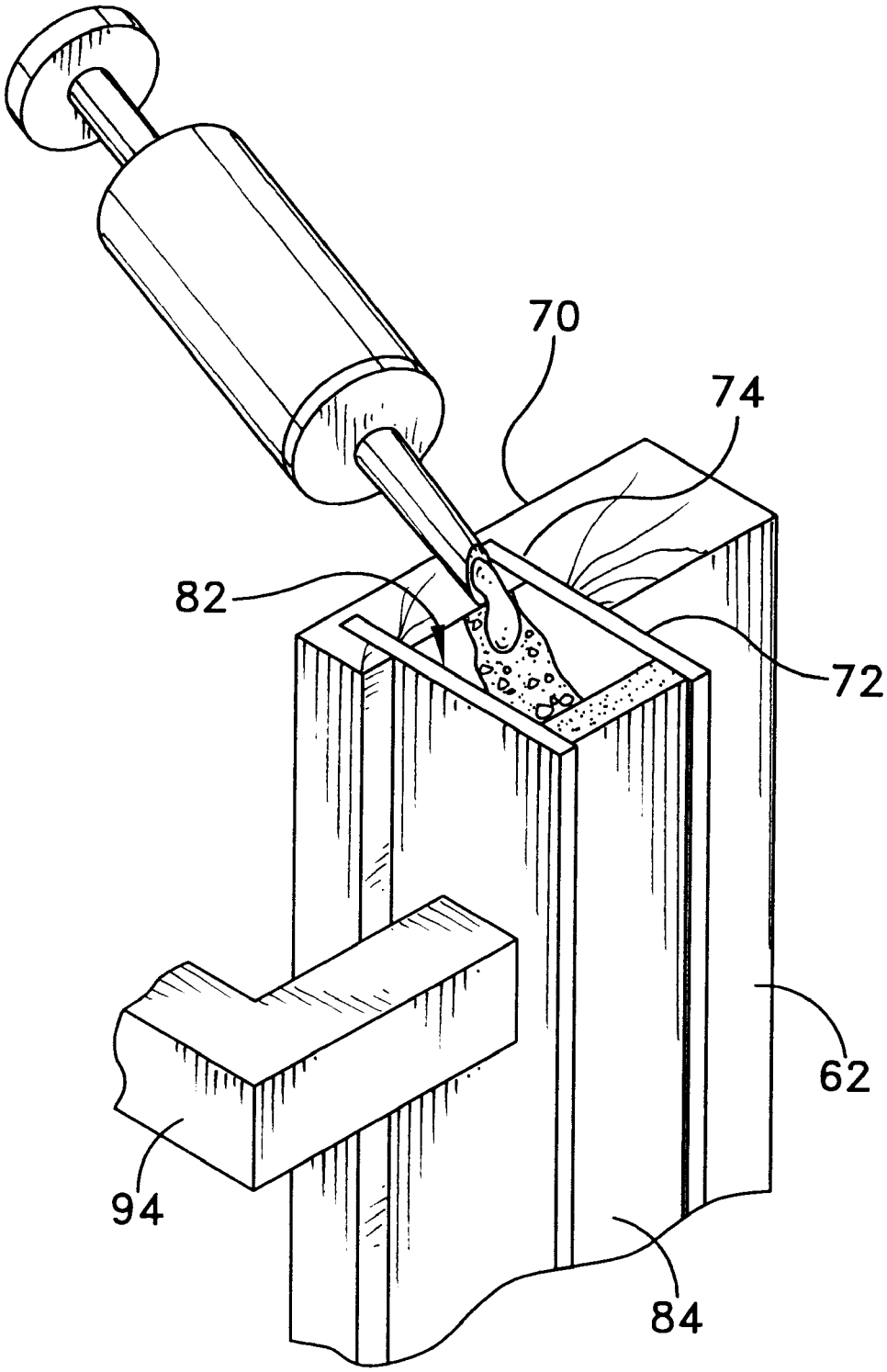
FIG. 7 is a perspective view showing further steps in connection with forming a cured-in-place foam.

Referring to FIGS. 3 and 4, both spaced sheet metal sheathing sheets on opposite sides of the door light preferably are engaged in kerfs or slots 70 in the adjacent framing elements, which can be of wood or other material and if made of wood preferably also are clad (not shown). The slots 70 for the facing sheets 62 in FIG. 4 diverge outwardly from one another and relative to their respective planes parallel to the plane of the wall. In the disclosed embodiment the angle is about 30 degrees from parallel to the plane of doorway. FIGS. 3, 5 and 7 show a corresponding embodiment in which the kerfs or slots 70 are parallel.

Figure 8:
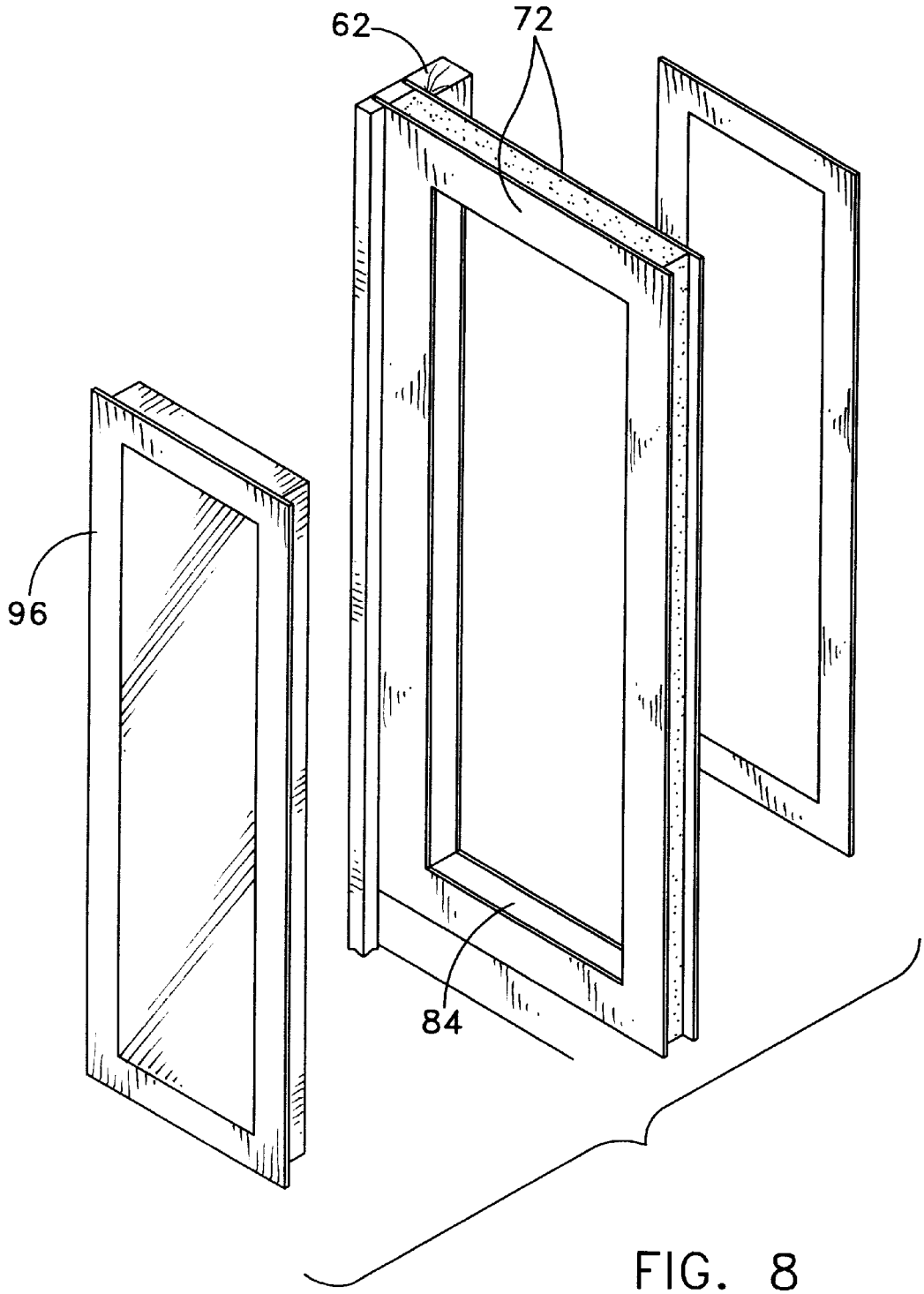
FIG. 8 is a perspective view illustrating the installation of a framed pane.

As the foam injected between the sheets expands, it exerts an outward force on the sheets 72. This force is oriented in a direction that presses the sheathing sheets 72 against the outside faces of the kerfs or slots 70, provides a secure structural engagement, and positively locates the facing sheets at the nominal position at the outside faces of the kerfs or slots. A rabbet 92 can be formed in the frame members on one side for further support, or alternatively oppositely facing rabbets can define a channel in which the slots 70 are provided along the inner corners. An inserted strip 84 can be employed to further close off the volume for expansion of the foam core. Alternatively, the foam can be permitted to expand beyond the edges of the facing sheets and can be trimmed. During injection and curing of the foam, it is preferable to hold the elements bounding the volume for the foam core in an assembly jig 94, shown generally in FIG. 7. After curing, the now-rigid structure can be removed from the jig and a framed pane 96 can be installed as shown in FIG. 8.

Along the inner edge, the facing sheets 72 of the sidelight are cut at a distance from the outer edge or tab 74 that engages in the slot 70 in the framing structure (e.g., 62). This provides a gap or opening for at least one panel, such as a framed glass pane 96. Instead of a framed glass pane, the invention can support other inserts such as an opaque raised panel or a transparent or translucent plastic or glass arrangement, a mounting for glass tiles or blocks or the like.

The outer framing members 62 of the entranceway structure can be nailed or attached by screws 98 to the rough framing elements 32 defining the entranceway 22. The entranceway 22 is in some ways similar to a pre-hung door frame, having a finish framing structure with elongated frame elements dimensioned to fit within and to be attached to corresponding rough framing elements 32. On the other hand, the entranceway structure as described, and in particular the intimate rigid attachment of its structural parts as provided by the notches/tabs 70/74 and the foam core 82, are such that the entranceway of the invention can be relied upon for structural support to a greater extent than known arrangements in which the panel parts are less securely and integrally attached to the frame elements.

The method steps involved in producing the structure as described are shown in FIGS. 5–8. These steps can be accomplished at the building site, but preferably are conducted at the factory, and the entranceway 22 is shipped to the installation site in a substantially finished condition, ready to be placed, aligned and permanently attached in a manner similar to a pre-hung door, in a wall with a framed opening between at least two spaced framing structures in the wall.

As shown in FIG. 5, at least one of the framing structures that will form a perimeter around a panel, has a slot or kerf 70 cut to a depth extending laterally from the opening into the framing structure. This slot will receive a protruding edge 74 of a sheathing skin 72 of sheet metal or the like, and the frame element, which can also be rabetted as shown, will form one of the bounding edges of a panel of the door sidelight or the like. In certain embodiments the kerfs for the sheathing sheets diverge and one is adjacent to a corner of a rabet. In other possible embodiments the kerfs are parallel. The kerfs can be of different widths or depths. One or both sheets can be supported wholly or partly on a stepped edge such as the side of a rabbet or a sidewall of a channel in the framing.

Figure 6:
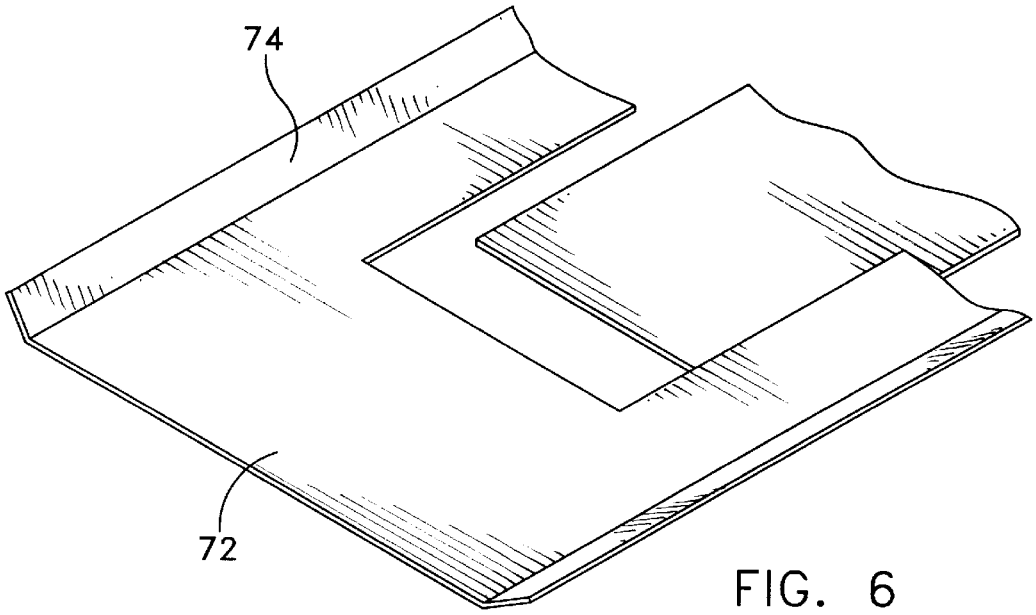
FIG. 6 is a cutaway perspective showing additional steps associated with forming surface or metal skin members, including according to the embodiment of FIG. 3.

The sheathing comprises at least one facing sheet 72 whose edge 74 will protrude from the panel part of the finish structure into the slot 70 or kerf in the framing part 62. As shown in FIG. 6, the facing sheet can form a frame around an opening that will be occupied by a framed pane or a decorative panel 96. The pane or panel can be rectangular or oval or another shape. The space needed for the framed pane or panel is stamp or punch/die cut from the sheet. The sheet can be a galvanized steel sheet and can be pre-embossed with a wood simulative surface configuration (not shown) and can be pre-painted or coated.

The edges 74 of the facing sheet 72 are preferably folded to an angle corresponding with the slot 70 in the framing part. The edges are inserted into the slots or kerfs. It is possible to insert the edges laterally, perpendicular to the plane of the frame element, by laterally pushing the frame elements into place onto the sheathing sheets while the sheathing sheets are held parallel to one another at the spacing provided between the slots or kerfs 70. The sheets also can be inserted by sliding them endwise into the slots (or endwise into a single wide slot forming a channel and against the opposite sides of such channel.

As shown in FIG. 7, the portion of the sheathing sheet 72 that does not rest against the rabbet 92 for support can be held in position using a portion of a jig 94 to fix its position against the force of the expanding foam core 82 and prevent bulging. In addition to being supported by the slots 70 and the rabbet 92 in the framing part 62, the sheathing sheets 72 are spaced near their inner edges by the wood, Styrofoam or similar strip 84 placed between the sheets and thus defining a substantially closed volume for the foam core 82.

The foam is applied as a liquid resin with a gas evolving blowing agent that expands the resin into a closed cell foam after the foam is applied by pouring or similarly injecting the resin into the hollow volume defined between the sheathing sheets 72. The foam is tacky and bonds to all inward facing surfaces. The foam expands to fill the available volume and cures to provide a relatively solid (albeit foamed) core that is intimately attached to the frame, the sheathing and the inward edge confining strip.

The result is a finished frame construction as shown in FIG. 8, with two sheet metal facing sheets 72 rigidly attached to a framing element and correctly positioned relative to the frame and one another so as to resemble a wood frame or edging around an insert such as a decorative and/or light transmissive panel. The insert can be a glass carrying panel 96 with a molding frame having flanges that fit in the opening in the sheathing, the molding frame being attachable by screws or the like (not shown) to a molding frame applied to the sheathing structure from the opposite side.

The invention as described is apt for use as a door sidelight or similar structure, and can be used for other sorts of structures in which facing panels and perimeter framing members bound a foamed core.

A number of additional variations are also possible and should be apparent in view of the foregoing explanation and examples. Many of the structural aspects that are otherwise known in vanities, sinks and basins can be applied to the invention, and need not be discussed in detail. The invention is capable of application to a range of embodiments, and reference should be made to the appended claims rather than the foregoing discussion of preferred arrangements, to determine the scope of the invention in which exclusive rights are claimed.

What is claimed is:

1. A building structure comprising:

a framed opening between at least two spaced framing structures in a wall, wherein at least one said framing structure has a slot defining a depth extending laterally from the opening into the framing structure;

a finish structure mounted in the framed opening, the finish structure comprising at least one facing sheet that protrudes into the slot by a distance less than or equal to said depth; and, wherein the finish structure comprises a foam portion formed in situ, the foam portion extending up to and abutting the framing structure containing the slot.

2. The building structure of claim 1, wherein the finish structure comprises two said facing sheets spaced from one another and oriented substantially parallel to a plane of the wall, the sheets extending over at least a part of a lateral width of the opening and the foam portion being disposed between the sheets.

3. The building structure of claim 2, wherein each of said spaced facing sheets extends into a slot in the framing structure.

4. The building structure of claim 3, wherein the slots for the facing sheets diverge relative to their respective planes parallel to the plane of the wall.

5. The building structure of claim 3, wherein the slots for the facing sheets are parallel to one another and parallel to the plane of the wall.

6. The building structure of claim 2, wherein the facing sheets are cut at a distance from the framing structure, thereby defining an opening for at least one panel.

7. The building structure of claim 6, further comprising a strip disposed between the facing sheets adjacent to the opening for the panel, the strip, the facing sheets and the framing structure defining an at least partly closed volume occupied by the foam portion.

8. The building structure of claim 1, wherein the framing structure comprises at least one elongated frame element dimensioned to be attached directly to a rough framing element.

9. The building structure of claim 7, wherein the framing structure defines a door sidelight.

10. A method of building construction comprising:

providing a wall with a framed opening between at least two spaced framing structures in the wall, wherein at least one said framing structure has a slot defining a depth extending laterally from the opening into the framing structure;

providing a finish structure for the framed opening, the finish structure including at least one facing sheet that protrudes from the finish structure;

mounting the finish structure in the framed opening, including placing a protruding part of the facing sheet in the slot, and adjusting a position of the finish structure such that the protruding part extends into the slot by a distance less than or equal to said depth; and, applying a foam and curing the foam in situ, to form a cured foam portion extending up to and abutting the framing structure containing the slot.

11. The building construction method of claim 10, wherein providing the finish structure includes placing two said facing sheets at a space from one another, oriented substantially parallel to a plane of the wall, the facing sheets extending over at least a part of a lateral width of the opening and wherein applying the foam comprises injecting the foam between the facing sheets to form a foam portion between the sheets, bounded by the facing sheets and the framing structure.

12. The building construction method of claim 11, comprising placing each of said spaced facing sheets in a slot in the framing structure and positioning the facing sheets to form inner and outer surfaces of at least part of a panel.

13. The building construction method of claim 12, wherein two slots for the facing sheets diverge relative to their respective planes parallel to the plane of the wall, and wherein injecting the foam between the facing sheets urges the facing sheets apart and locks the facing sheets in the slots.

14. The building construction method of claim 12, wherein the slots for the facing sheets comprises supporting edges that are substantially parallel to the plane of the wall and wherein injecting the foam between the facing sheets urges the facing sheets apart and against the supporting edges.

15. The building construction method fo claim 13, further comprising placing a strip between the facing sheets before injecting the foam, so as to at least partly bound a volume in which the foam expands after injection.

16. The building construction method of claim 10, further comprising forming the facing sheets with edges at a distance from the framing structure, defining an opening for receiving an insert sized for the opening.

17. The building construction method of claim 16, wherein the insert comprises at least one of a raised panel and an at least partly light transmissive pane.

18. The building construction method of claim 17, wherein the framing structure comprises at least one elongated frame element that is attached directly to a rough framing element of a doorway.

19. The building construction method of claim 18, wherein the insert comprises a pane in a doorway sidelight.

* * * * *